US006743451B2

(12) United States Patent
Rasile et al.

(10) Patent No.: US 6,743,451 B2
(45) Date of Patent: Jun. 1, 2004

(54) RESEALABLE BAG WITH ARCUATE RUPTURABLE SEAL

(75) Inventors: William F. Rasile, Allison Park, PA (US); Aaron Schwartz, Pittsburgh, PA (US)

(73) Assignee: H. J. Heinz Company, Pittsburgh, PA (US)

( * ) Notice: Subject to any disclaimer, the term of this patent is extended or adjusted under 35 U.S.C. 154(b) by 213 days.

(21) Appl. No.: 10/122,354

(22) Filed: Apr. 16, 2002

(65) Prior Publication Data

US 2002/0166463 A1 Nov. 14, 2002

Related U.S. Application Data

(60) Provisional application No. 60/283,610, filed on Apr. 16, 2001.

(51) Int. Cl.[7] ..... B65D 85/72

(52) U.S. Cl. ..... 426/112; 426/115; 426/119; 426/120; 426/129; 206/219; 206/222; 383/203

(58) Field of Search ..... 426/112, 115, 426/119, 120, 122, 123, 129; 383/203, 204, 38–40; 206/219, 222; 438/255, 133, 237; 257/481

(56) References Cited

U.S. PATENT DOCUMENTS

| | | | | |
|---|---|---|---|---|
| 2,424,536 A | | 7/1947 | Mayer et al. | |
| 2,606,121 A | | 8/1952 | Peters | |
| 2,647,681 A | | 8/1953 | Paoli | |
| 3,293,048 A | | 12/1966 | Kitterman | |
| 3,573,069 A | | 3/1971 | Keller et al. | |
| 4,256,256 A | | 3/1981 | Meyers | |
| D261,988 S | | 11/1981 | Nichols | |
| 4,358,466 A | | 11/1982 | Stevenson | |
| 4,596,713 A | | 6/1986 | Burdette | |
| 4,806,371 A | | 2/1989 | Mendenhall | |
| 4,867,995 A | | 9/1989 | Oaks | |
| 5,067,822 A | | 11/1991 | Wirth et al. | |
| 5,075,119 A | | 12/1991 | Mendenhall | |
| 5,198,055 A | | 3/1993 | Wirth et al. | |
| 5,287,961 A | | 2/1994 | Herran | |
| 6,254,907 B1 | | 7/2001 | Galomb | |
| 6,491,159 B2 | * | 12/2002 | Shibata | 206/219 |
| 6,669,013 B1 | * | 12/2003 | Villanueva | 206/219 |

FOREIGN PATENT DOCUMENTS

AU 199897029 A1 7/1999

* cited by examiner

*Primary Examiner*—Drew Becker
(74) *Attorney, Agent, or Firm*—Burns, Doane, Swecker & Mathis, L.L.P.

(57) ABSTRACT

A recloseable bag for marinading food including a flexible plastic sheet having side edges, a flexible foil sheet having side edges and sealed to the flexible plastic sheet along the edges of the sheets to form a generally rectangular bag having first and second ends and opposed sides, a recloseable closure joining the flexible plastic sheet and the flexible foil sheet adjacent the first end of the bag, and an arcuate rupturable seal extending from one opposed side to another opposed side and joining the flexible plastic sheet and the flexible foil sheet. The arcuate rupturable seal, the opposed sides, and the second end form a marinade storage compartment. A top of the arcuate rupturable seal is approximately centrally located between the opposite sides, and the recloseable closure, the opposed sides, and the second end form a food storage compartment for marinating food upon opening of the arcuate rupturable seal.

16 Claims, 5 Drawing Sheets

RESEALABLE BAG WITH ARCUATE RUPTURABLE SEAL

This applications is based on provisional application No. 60/283,610 filed Apr. 16, 2001.

BACKGROUND

Field of the Invention

The present invention relates to a resealable bag useful for marinating food. In particular, the invention relates to a portable bag for storing two foods for later mixture or for marinating food that is added to the bag.

BRIEF DESCRIPTION OF THE DRAWING FIGURES

Objects and advantages of the invention will become apparent from the following detailed description of preferred embodiments in connection with the accompanying drawings in which like numerals designate like elements and in which.

DETAILED DESCRIPTION OF THE PREFERRED EMBODIMENTS

Figures 1, 2:
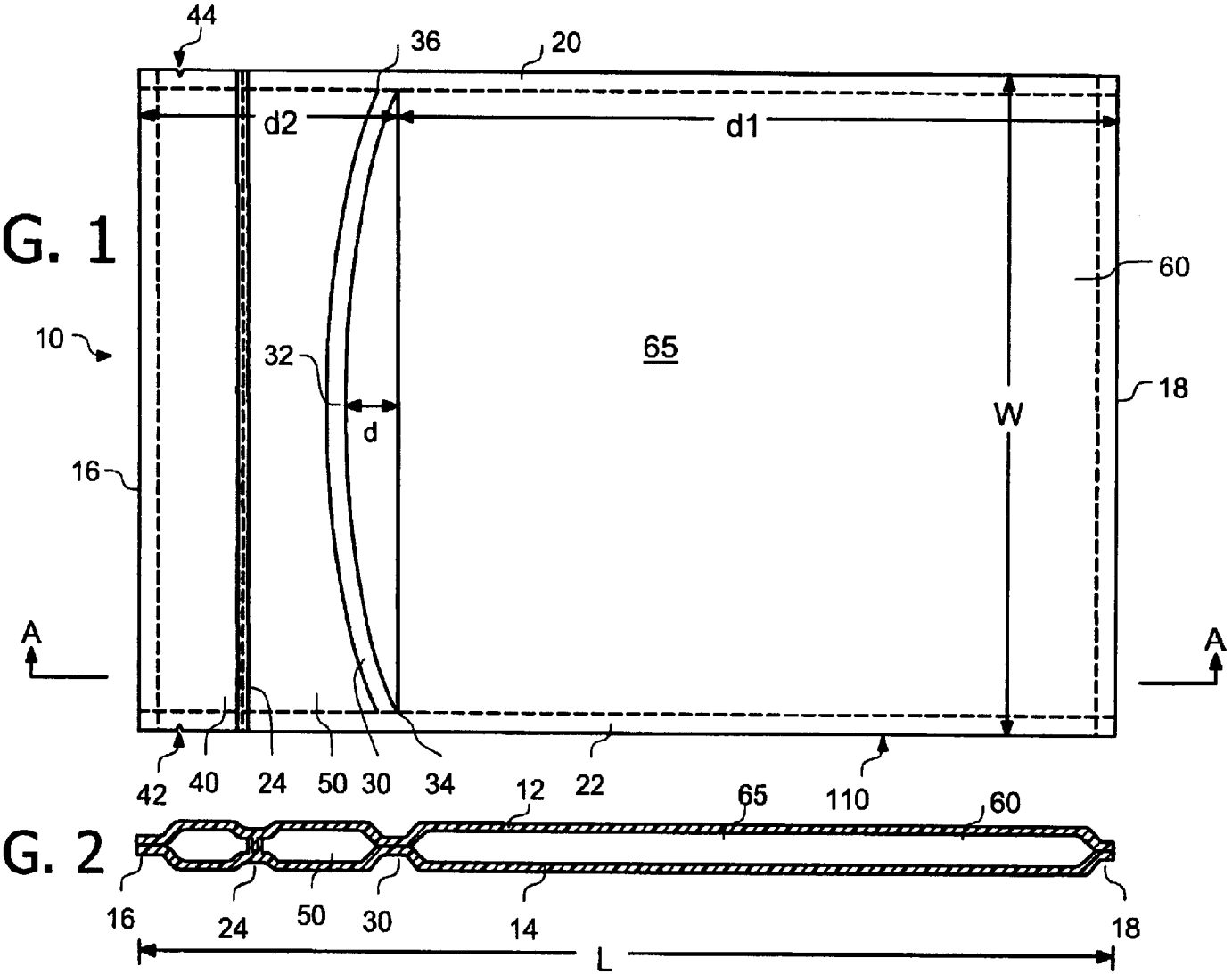
FIG. 1 illustrates a resealable bag according to an embodiment of the present invention.
FIG. 2 illustrates a cross sectional view of an embodiment of a resealable bag corresponding to section A—A of FIG. 1.

FIGS. 1 and 2 illustrate a resealable bag useful for marinading food according to a preferred embodiment of the invention. The generally rectangular resealable bag 10 has a flexible top plastic sheet 12 and a flexible bottom foil sheet 14, sealed together along the periphery of the sheets. The bag 10 has sealed ends 16 and 18 and sealed opposed sides 20 and 22. The sheets 12 and 14 are formed of food-safe materials. In addition, the sheets 12 and 14 preferably have good oxygen barrier properties to keep any food within the bag fresh.

The flexible plastic sheet 12 is preferably transparent, so the contents of the bag may be seen.

A reclosable and resealable closure 24, which joins the sheets 12 and 14 together, is located at a distance from one sealed end 16 of the bag. The reclosable closure 24 and the sealed end 16 of the bag 10 define a openable region 40 therebetween.

The recloseable closure 24 may be of the type referred to as a "zipper lock" closure, and may be formed by applying a polymer strip to the inside face of each sheet 12 and 14, each polymer strip having an integrally formed rib, the ribs having interengaged male and female portions whereby the ribs can be connected to one another along their length. Alternatively, each of the sheets 12 and 14 may have an integrally formed rib, the ribs having interengaged male and female portions whereby the ribs can be connected to one another along their length, making the application of the polymer strips with ribs unnecessary. The recloseable closure 24 resists tearing, so food and marinade within the bag do not leak from the bag 10. Further, optionally, the sheets 12 and 14 may be further reinforced against tearing by thickening one or both sheets.

A rupturable seal 30 joins the sheets 12 and 14, and portions of which are located at a distance from the sealed end 16 that is equal to about one-quarter to about one-half of the length L of the bag between ends 16 and 18. In a preferred embodiment, the distance between the rupturable seal 30 and the sealed end is between one-quarter and one-third of the length L of the bag between ends 16 and 18. In another preferred embodiment, the shortest distance between the rupturable seal 30 and the sealed end 16 is 27.8% of the length L of the bag. As an example, when the length of the bag L is 13 inches, the distance d2 is preferably about 3 inches, and the distance d1 is preferably about 10 inches, although other dimensions may be used.

The rupturable seal 30 is arcuate in shape, as illustrated in FIG. 1, and extends from one sealed opposed side 20 to the other sealed opposed side 22, so that the top of the arch 32 is located in a central region between opposed sealed sides 20 and 22, so the top of the arch 32 is closer to the reclosable closure 24 than are the ends of the arch 34 and 36. The arcuate shape of the rupturable seal 30 causes a stress concentration in the rupturable seal 30 at the central region when bag is opened, so the sheets joined by the rupturable seal 30 are more easily separated than they would be if the rupturable seal were straight.

By way of example and not of limitation, for a bag with a width W of about 8 ½ inches, an effective depth d for the arcuate seal is approximately 1 inch, although other depths and degrees of curvature may also be used.

The rupturable seal 30 defines a central compartment 50 between the rupturable seal 30 and the recloseable closure 24, and defines a marinade storage compartment 60 between the sealed end 18 and the rupturable seal 30.

A marinade 65 is stored in the marinade storage compartment 60. A marinade is an edible substance which can impart a flavor or flavors to a food. The marinade 65 is preferably liquid or liquid-like. The marinade may alternatively be dry and may, for example, be a dry mixture of seasonings.

Figure 3:
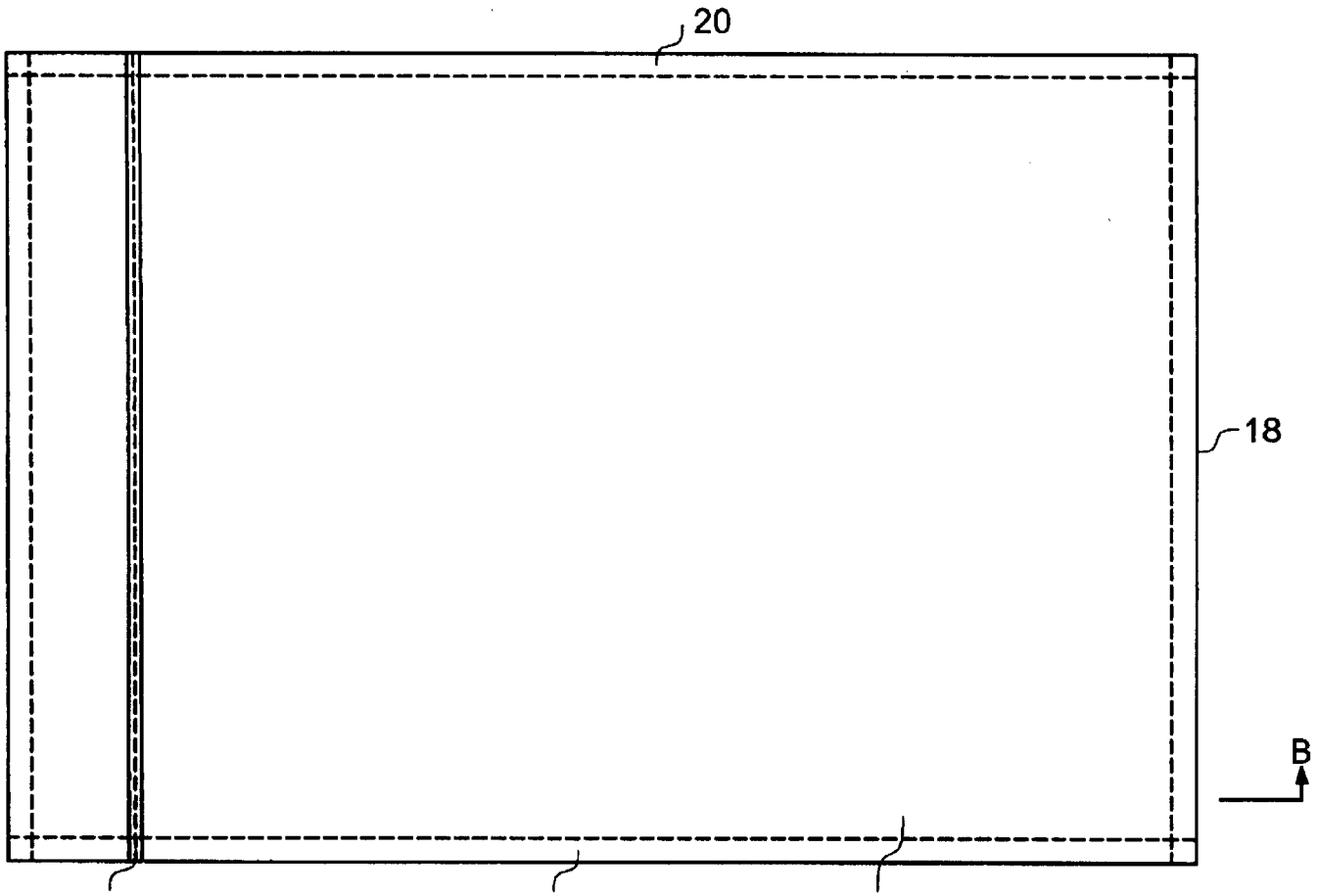
FIG. 3 illustrates a resealable bag of FIG. 1 with the rupturable seal opened.
Figure 4:
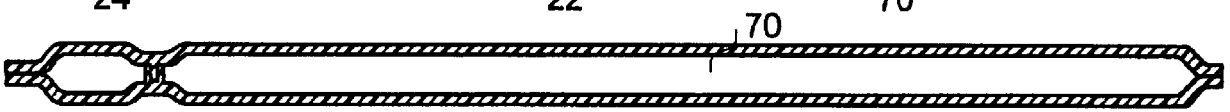
FIG. 4 is a cross sectional view corresponding to section B—B of FIG. 3.

Referring next to FIGS. 3 and 4, when the rupturable seal 30 has been opened, a food storage compartment 70 is defined by the reclosable closure 24, the sealed end of the bag 18, and the sealed opposed sides of the bag 20 and 22. Once the rupturable seal 20 is opened, food to be marinated may be placed in the food storage compartment 70, and the reclosable seal may be reclosed, allowing the food to be coated with the marinade 40.

Notches 42 and 44 are preferably provided in the peripheral seal on the opposed sides 20 and 22 in the openable region of the bag 40, to provide a tearable end for the bag, the tearable end being positioned outside of the recloseable closure 24.

When it does not contain food to be marinated, the bag 10 may be folded into thirds for convenience, by folding the ends of the bag 18 and 16 toward the center of the bag 10 in an overlapping manner.

Figure 5:
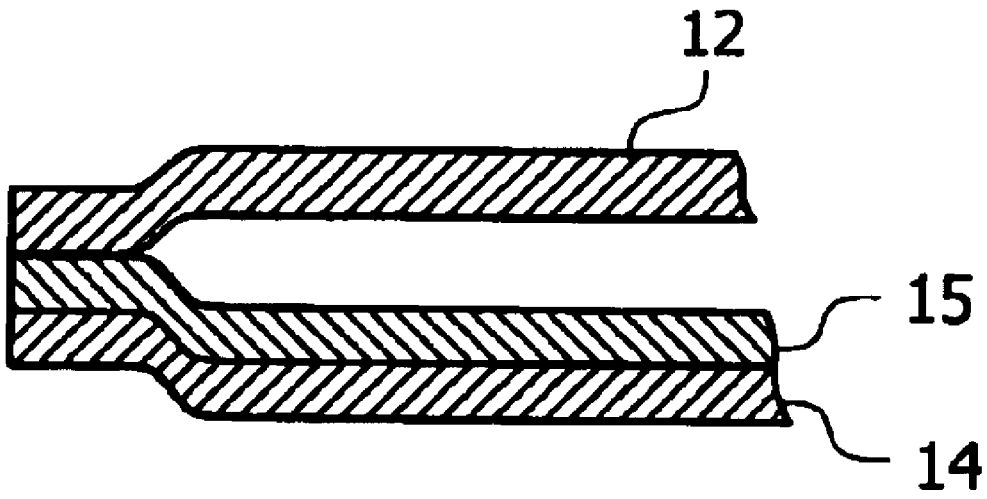
FIG. 5 is a cross sectional view of a portion of a resealable bag according to another embodiment of the invention.

In another preferred embodiment, and as illustrated in FIG. 5, a thin plastic layer 15 is located on an inner face of the flexible foil sheet 14, arranged so the plastic layer 15 and the flexible plastic sheet 12 form the inside of the bag 10, and the plastic layer 15 and the flexible plastic sheet 12 will be in contact with food and marinade in the bag 10.

The peripheral edges of the of the sheets 16, 18, 20, and 22 may be sealed by adhesion, by fusion of the thermoplastic materials (heat-sealed), or other appropriate method as will be readily appreciated by those of skill in the art.

In an alternative embodiment, the rupturable seal 30 is approximately straight rather than arcuate and is approximately parallel to the recloseable closure 24.

In yet another alternative embodiment, the end 18 of the bag 10 is not sealed, and the marinade storage compartment 60 is empty, so that marinade or other items may be placed in the marinade storage compartment 60 prior to sealing the end 18. After the marinade is placed in the bag 10, the end 18 of the bag is sealed, and the bag 10 is ready to be used.

In use, the consumer tears off the tearable end at a notch 42 and/or 44, opens the reclosable closure 24, pulls apart the rupturable seal 30, places food to be marinated into the food storage compartment 70 with the marinade 65 already contained in the compartment, and recloses the reclosable closure 24 to allow the food to be marinated. Thereafter, the user can open the closure 24 and retrieve the food from the compartment 70.

Figure 6:
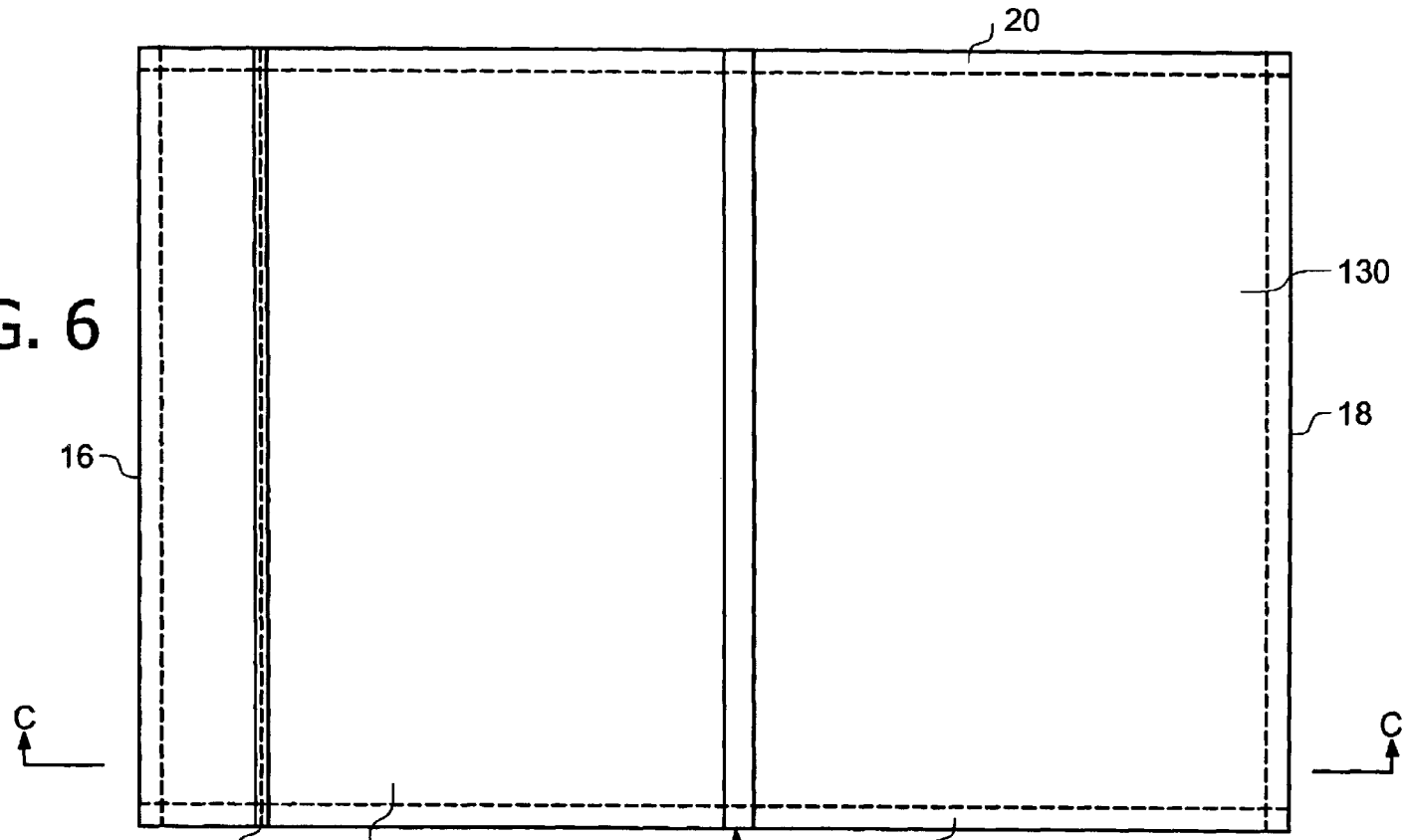
FIG. 6 illustrates a resealable bag according to another embodiment of the invention.
Figure 7:
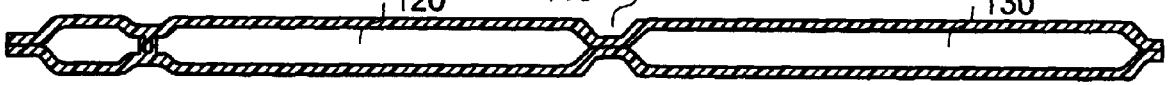
FIG. 7 is a cross sectional view corresponding to section C—C of FIG. 6.

In still another preferred embodiment, shown in FIGS. 6 and 7, a rupturable seal 110, which extends from one opposed sealed side 20 to another opposed sealed side 22, is located approximately halfway between the zipper type seal 24 and the sealed end 18. The rupturable seal 110 may be either straight, as shown in FIG. 6, or optionally may be arcuate. The rupturable seal 110, the reclosable closure 24, and the opposed sides 20 and 22 define a central storage compartment 120. The rupturable seal 110, the sealed end 18, and the two opposed sides 20 and 22 define an end storage compartment 130. Various foods may be stored in the central storage compartment 120 and the end storage compartment 130. As an example, liquid or liquid-like food can be stored in the end storage compartment 130, and dry or moist food can be stored in the central storage compartment 120. Examples of dry or moist food include uncooked dry pasta, semicooked dry pasta, semicooked moist pasta, and uncooked or semicooked rice, dry soup components solid components of potato salads or green salads. Examples of liquids or liquid-like food include broth, sauce, and salad dressing. It will be appreciated by those skilled in the art that many other types of food that benefit from being stored separately may be stored in the compartments 120 and 130.

The foods are stored separately within their compartments 120 and 130 until the consumer is ready to prepare the foods.

By way of example and not of limitation, dry pasta may be stored in the central storage compartment 120, and pasta sauce may be stored in the end food compartment 130. The consumer opens the sealed end 16, opens the closure 24, and opens the rupturable seal 110 which separates the compartments 120 and 130, allowing the sauce to coat the pasta. The user reseals the closure 24, and places the resealed bag 10 in hot water to cook the pasta and sauce. Thereafter, the user can open the closure 24 and retrieve the food.

As another example, the center storage compartment 120 can store food such as the salad components of potato salad while the end storage compartment 130 can store dressing for the potato salad. As another example, lettuce or other salad components can be stored within the center storage compartment 120 and a dressing for the salad can be stored within the end food compartment 130.

As another example, moist semi-cooked pasta may be stored in the central storage compartment 120, and pasta sauce may be stored in the end storage compartment 130. The user may then heat the food within the bag by placing the bag in hot water to heat the food without opening the rupturable seal. The user may then open the closure 24 and the rupturable seal 110 to allow the heated foods to mix and to retrieve the food.

It is also envisioned that above-mentioned foods mentioned as being stored in the end storage compartment can be stored in the central storage compartment, and the foods mentioned as being stored in the central storage compartment can be stored in the end storage compartment.

For bags intended to be heated, such as those bags to be used for soup, the sheets 12 and 14 should be high temperature materials which may be boiled or otherwise heated.

In another embodiment, the bags illustrated in FIGS. 1–4 or FIGS. 6–7 can be joined at the side edges to form a multi-unit package. This allows a consumer to purchase more than one conveniently packaged marinade bag, and to use only the desired amount of marinade capacity.

Figure 8:
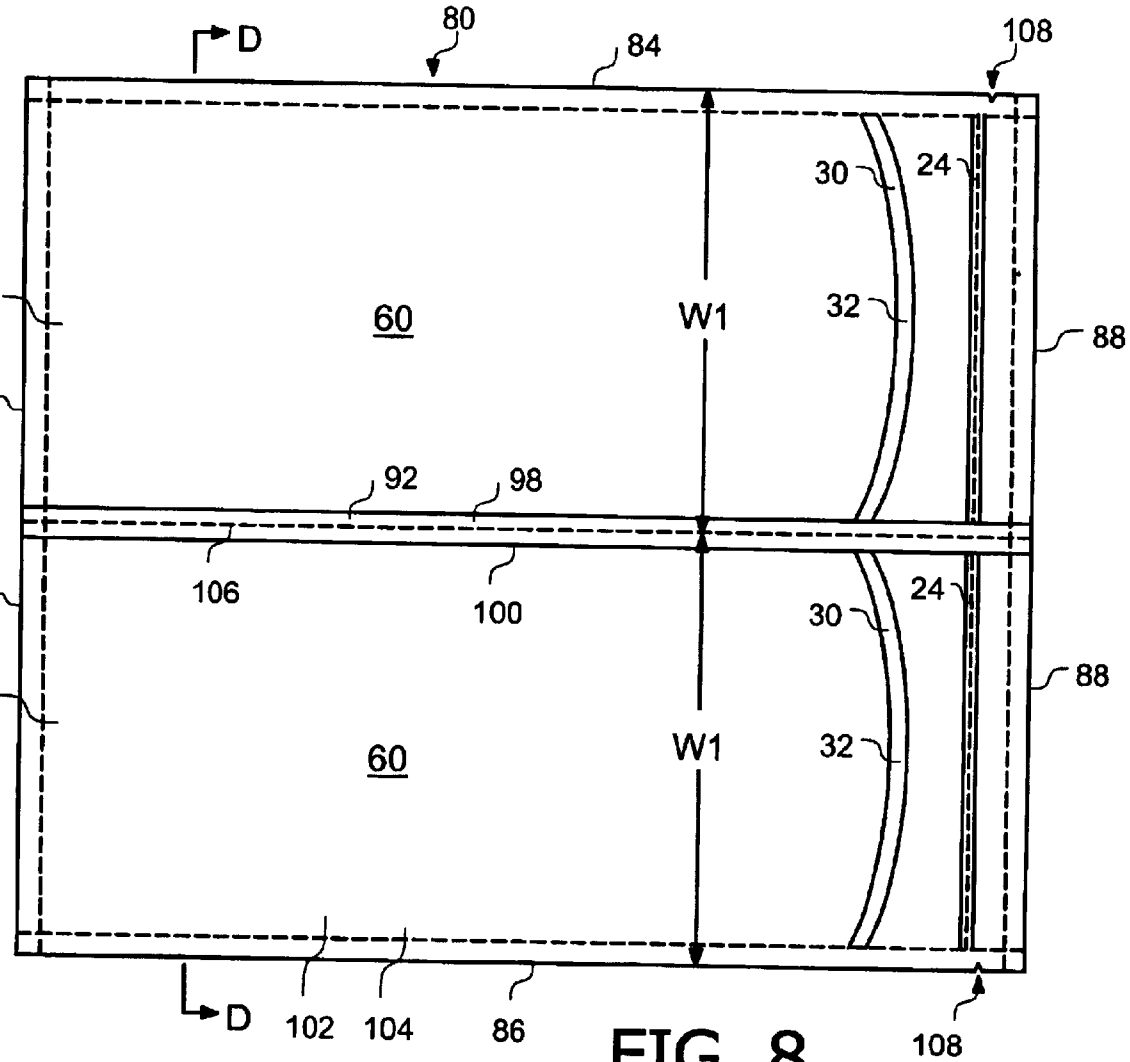
FIG. 8 illustrates a multi-unit package according to another embodiment of the invention.
Figure 9:
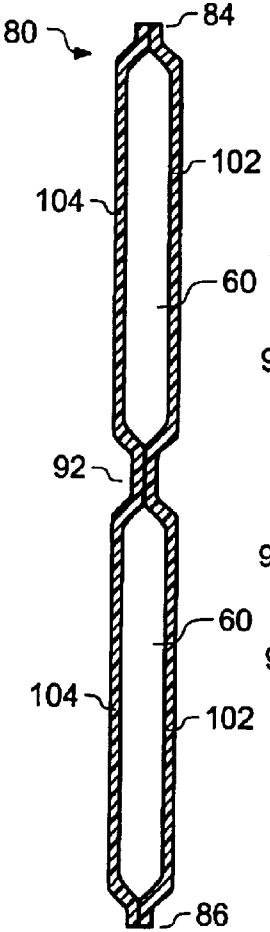
FIG. 9 is a cross sectional view corresponding to section D—D of FIG. 8.

FIGS. 8 and 9 illustrate an embodiment of a dual package of reclosable bags for marinating food with two bags, although it also envisioned that a package with more than two bags could be formed.

In the embodiment illustrated in FIGS. 8 and 9, the package 80 includes a flexible top plastic sheet 102 and a a flexible bottom foil sheet 104 sealed to the flexible plastic sheet along the periphery of the package 80 to form opposed sealed sides 84 and 86, and opposed sealed ends 88 and 90. At a location approximately central between the side edges 84 and 86, at a joined area 92, the flexible plastic sheet 102 is joined to the flexible foil sheet 104 along a line extending from one end 88 to the other end 90, thus forming two bags 94 and 96. Each bag 94, 96 has a generally rectangular shape, and opposed sealed first end 88 and second sealed end 90. The first bag 94 has a sealed side edge 98 that joins the sealed side edge 100 of the second bag 96 at the joined area 92. The second bag has sealed side edges 100 and 86.

A recloseable closure 24 joins the flexible plastic sheet and the flexible foil sheet adjacent the first end 88 of each bag. The recloseable closure 24 and the first sealed end 88 of the bag define an openable region therebetween.

For the first bag, an arcuate rupturable seal 30 extends from one opposed side 84 to the other side 98 of the first bag 94 and joins the flexible plastic sheet 102 and the flexible foil sheet 104. A top 32 of the arcuate rupturable seal 30 is approximately centrally located between said opposite sides 84 and 98. A marinade storage compartment 60 is formed by the arcuate rupturable seal 30, the opposed sides 84, 98, and the second end 90. The recloseable closure 24 with said opposed sides 84, 98 and said second end 90 form a food storage compartment 70 (not shown) for marinating food upon opening of the arcuate rupturable seal 30.

The second bag 96 also has an arcuate rupturable seal 30 which forms a marinade compartment 60 with the opposed sides 86, 100 and the sealed second end 90.

Perforations 106 are formed in the joined area 92 between the bags 94, 96 to facilitate separation of the bags 94, 96 by the consumer. It will be clear to one of skill in the art that in an alternative, the bags 94, 96 can also be cut apart by the consumer, and that the perforations 106 can be replaced by other structures to assist the consumer in separating the bags, for example, notches, a single large perforation, indentations, or thinner portions of the joined area 92.

Notches 108 located at a first sealed end 88 of the bag in the side edges 84, 86 can be used by a consumer to tear the sealed end 88 from the bag, in preparation for opening the recloseable closure 24.

Many types of food items, including marinade 65 or any of the foods discussed above, can be stored in each bag of the package 80.

It will be recognized that various sizes can be used for the single bags or the multi-unit packages. The width W1 of each bag 92, 94 in the dual-package 80 can be less than that of the single marinade bag 10 described above, so that each bag contains less marinade and has a smaller food capacity, suitable for use by smaller families or for individuals. Alternatively, each bag 92, 94 could be the same size or even larger than the marinade bag 10, so that the consumer can conveniently purchase a multi-package of larger marinade bags.

In a preferred embodiment, the package 80 can be folded into thirds prior to use.

Other food storage bags discussed herein, such as the food storage bag of FIGS. 6, 7 can also be joined as side edges in a manner similar to that described above.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A recloseable bag for marinading food, comprising:

a flexible plastic sheet having side edges;

a flexible foil sheet having side edges and sealed to said flexible plastic sheet along the edges of the sheets to form a generally rectangular bag having a first end, a second end, and opposed sides;

a recloseable closure joining the flexible plastic sheet and the flexible foil sheet adjacent the first end of the bag;

an arcuate rupturable seal extending from one opposed side to another opposed side and joining the flexible plastic sheet and the flexible foil sheet;

said arcuate rupturable seal with said opposed sides and said second end forming a marinade storage compartment for storing marinade; and marinade in said marinade storage compartment;

wherein a top of the arcuate rupturable seal is approximately centrally located between said opposite sides;

said recloseable closure with said opposed sides and said second end forming a food storage compartment for marinating food upon opening of said arcuate rupturable seal.

2. A reclosable bag for marinading food as in claim 1, wherein said flexible foil sheet further comprises a plastic layer bonded to said flexible foil sheet, arranged such that said plastic layer is disposed against said flexible plastic sheet.

3. A reclosable bag for marinating food as in claim 1, wherein said arcuate rupturable seal is located at a distance from the first end equal to between about one-quarter and one-half of a distance from the first end to the second end.

4. A reclosable bag for marinating food as in claim 1, wherein said arcuate rupturable seal is closer to the first end than to the second end.

5. A recloseable bag for marinating food as in claim 1, wherein said arcuate rupturable seal is located at a distance from the first end, said distance being between about one-quarter and about one-third of the length of the bag.

6. A recloseable bag for marinating food as in claim 1, wherein a shortest distance between the first end and the arcuate rupturable seal is 28% of the length of the bag.

7. A recloseable bag for storing food, comprising:

a flexible plastic sheet having side edges;

a flexible foil sheet having side edges and sealed to said flexible plastic sheet along the edges of the sheets to form a generally rectangular bag having a first end, a second end, and opposed sides;

a recloseable closure joining the flexible plastic sheet and the flexible foil sheet adjacent the first end of the bag; and an arcuate rupturable seal extending from one opposed side to another opposed side and joining the flexible plastic sheet and the flexible foil sheet;

said rupturable seal with said opposed sides and said second end forming an end storage compartment for storing a first food;

said rupturable seal with said opposed sides and said reclosable closure forming a central storage compartment for storing a second food;

a first food in said end storage compartment; and a second food in said central storage compartment, wherein the arcuate seal is approximately centrally located between said opposite sides.

8. A recloseable bag for storing food as in claim 7, wherein said first food is sauce and said second food is pasta.

9. A recloseable bag for storing food as in claim 7, wherein said first food is broth and said second food is rice.

10. A reclosable bag for storing and heating food as in claim 7, wherein said first food is broth and said second food is dry soup components.

11. A recloseable bag for storing food as in claim 7, wherein said first food is dressing and said second food is salad.

12. A package of reclosable bags for marinating food, comprising:

a flexible plastic sheet with side edges and end edges; and a flexible foil sheet with side edges and end edges;

the flexible foil sheet being sealed to said flexible plastic sheet along a periphery of the sheets and along a line located between the side edges of the sheets extending from a first end edge to a second end edge of the sheets to form a first bag and a second bag, each bag being generally rectangular and having opposed sides and a first end and a second end, each bag having:

a recloseable closure joining the flexible plastic sheet and the flexible foil sheet adjacent the first end of the bag, an arcuate rupturable seal extending from one opposed side to another opposed side of the bag and joining the flexible plastic sheet and the flexible foil sheet, said arcuate rupturable seal with said opposed sides and said second end forming a marinade storage compartment, and said recloseable closure with said opposed sides and said second end forming a food storage compartment for marinating food upon opening of said arcuate rupturable seal.

13. A package of reclosable bags for marinating food as in claim 12, wherein a top of the arcuate rupturable seal is approximately centrally located between said opposite sides.

14. A package of reclosable bags for marinating food as in claim 12, comprising:

at least one perforation in a joined area between the first bag and the second bag.

15. A package of reclosable bags for marinating food as in claim 12, comprising:

a marinade in the marinade compartment of the first bag and the second bag.

16. A recloseable bag for marinading food, comprising:

a flexible plastic sheet having side edges;

a flexible foil sheet having side edges and sealed to said flexible plastic sheet along the edges of the sheets to form a generally rectangular bag having a first end, a second end, and opposed sides;

a recloseable closure joining the flexible plastic sheet and the flexible foil sheet adjacent the first end of the bag; and an arcuate rupturable seal extending from one opposed side to another opposed side and joining the flexible plastic sheet and the flexible foil sheet;

said arcuate rupturable seal with said opposed sides and said second end forming a marinade storage compartment for storing marinade;

wherein a top of the arcuate rupturable seal is approximately centrally located between said opposite sides;

said recloseable closure with said opposed sides and said second end forming a food storage compartment for marinating food upon opening of said arcuate rupturable seal.

* * * * *